United States Patent [19]

Potard et al.

[11] Patent Number: 4,539,173

[45] Date of Patent: Sep. 3, 1985

[54] PROCESS FOR PREPARING PLATES OF A METALLIC OR SEMIMETALLIC MATERIAL FROM A LIQUID MASS

[75] Inventors: Claude Potard; Pierre Dusserre, both of Saint Egreve, France

[73] Assignee: Commissariat a l'Energie Atomique, Paris, France

[21] Appl. No.: 476,352

[22] Filed: Mar. 17, 1983

[51] Int. Cl.[3] ..... B22D 27/04

[52] U.S. Cl. ..... 264/570; 164/122.2; 264/299; 264/348

[58] Field of Search ..... 164/81, 47, 122.1, 122.2; 264/570, 298, 299, 304, 319, 332, 348

[56] References Cited

U.S. PATENT DOCUMENTS 2,875,108 2/1959 Pfann ..... 148/1
4,356,141 10/1982 Sanjurjo et al. ..... 264/332

FOREIGN PATENT DOCUMENTS 2361868 12/1973 Fed. Rep. of Germany .
1487587 10/1977 United Kingdom .
1524521 9/1978 United Kingdom .
2002651 2/1979 United Kingdom .

OTHER PUBLICATIONS

"Journal of Physics and Chemistry of Solids", J. B. Mullin et al., vol. 26, 1965, pp. 782–784.

*Primary Examiner*—Jan Silbaugh
*Assistant Examiner*—Hubert C. Lorin
*Attorney, Agent, or Firm*—James E. Nilles

[57] ABSTRACT

The invention relates to a process for producing plates of a metallic or semimetallic material.

The latter is in the form of a liquid mass entirely separated from the walls of a crucible by a liquid film of a second material. A group of plates is lowered into the crucible, in order that the liquid mass can solidify, while being separated from the plates by the protective liquid film.

Application is to the production of photovoltaic silicon plates.

4 Claims, 2 Drawing Figures

PROCESS FOR PREPARING PLATES OF A METALLIC OR SEMIMETALLIC MATERIAL FROM A LIQUID MASS

BACKGROUND OF THE INVENTION

The present invention relates to a process for the preparation of plates of a metallic or semimetallic material from a liquid mass by moulding and without direct contact with the walls of a container.

The preparation of semiconductor crystals in the form of plates suffers from disadvantages due to the contact between the liquid and its mould. Moreover, in crystal growth, the possible interactions between the material from which the mould is made and the liquid can lead to parasitic nucleation phenomena during solidification, as well as to mechanical stressed on cooling.

To obviate these disadvantages, use is made of processes in which the liquid mass of the material to be worked is separated from the walls of the crucible or mould by a liquid film of a second material, which is chemically inert relative to the first material, is not miscible therewith and has a good wetting power with respect to the crucible or mould walls. Vertical pulling or drawing methods already make use of the encapsulation principle (coating by an immiscible material).

SUMMARY OF THE INVENTION

The present invention relates to a process of this type making it possible to produce flat plates of a metallic or semimetallic material.

According to the main feature of the process according to the invention, the metallic or semimetallic material (called the starting material throughout the remainder of the text) is in the form of a liquid mass contained in a production device comprising on the one hand a crucible which also contains a second material, which is chemically inert with respect to the first, and on the other hand a shaping means, the second material having a density which is at the most equal to that of the first material and is immiscible therewith, whilst having a melting point well below that of the first material and a wetting power which is higher than that of the first material with respect to the production device, wherein the process comprises the following stages:

a mould having a group of parallel, equidistant, refractory plates is lowered into the crucible until the lower end of the plates comes into contact with the second material wetting the mould walls;

the material is made to penetrate the spaces between the plates and is separated from the latter by a liquid film of the second material;

planned cooling takes place until the material to be produced solidifies, the second material remaining in liquid form;

the plates are removed;

the second material in excess is discharged;

cooling takes place to ambient temperature;

and the film of the second material which could still adhere to the first is removed.

Such a process is of considerable interest in the preparation of silicon plates for use either as a substrate for the preparation, by vapour phase epitaxy, of photovoltaic silicon plates, or directly as photovoltaic cells.

In the production of photovoltaic cells, at present silicon is the material with the best price/conversion efficiency ratio. The most frequently used method for producing silicon at the present time consists of cutting large ingots obtained by controlled solidification into plates. This is difficult to carry out and involves high capital expenditure, large material and energy consumption levels and long and costly surface treatments. One of the most interesting applications of the process according to the invention is to the preparation of silicon plates at a lower cost and with a good surface state.

Advantageously, the second material for producing a liquid film preventing contact with the walls of the mould is an alkaline earth fluoride or a mixture of alkaline earth fluorides, e.g. a mixture of calcium and magnesium fluorides in the case of producing silicon plates.

BRIEF DESCRIPTION OF THE DRAWINGS

The invention is described in greater detail hereinafter relative to non-limitative embodiments and the attached drawings, wherein.

DETAILED DESCRIPTION OF THE INVENTION

Figure 1:
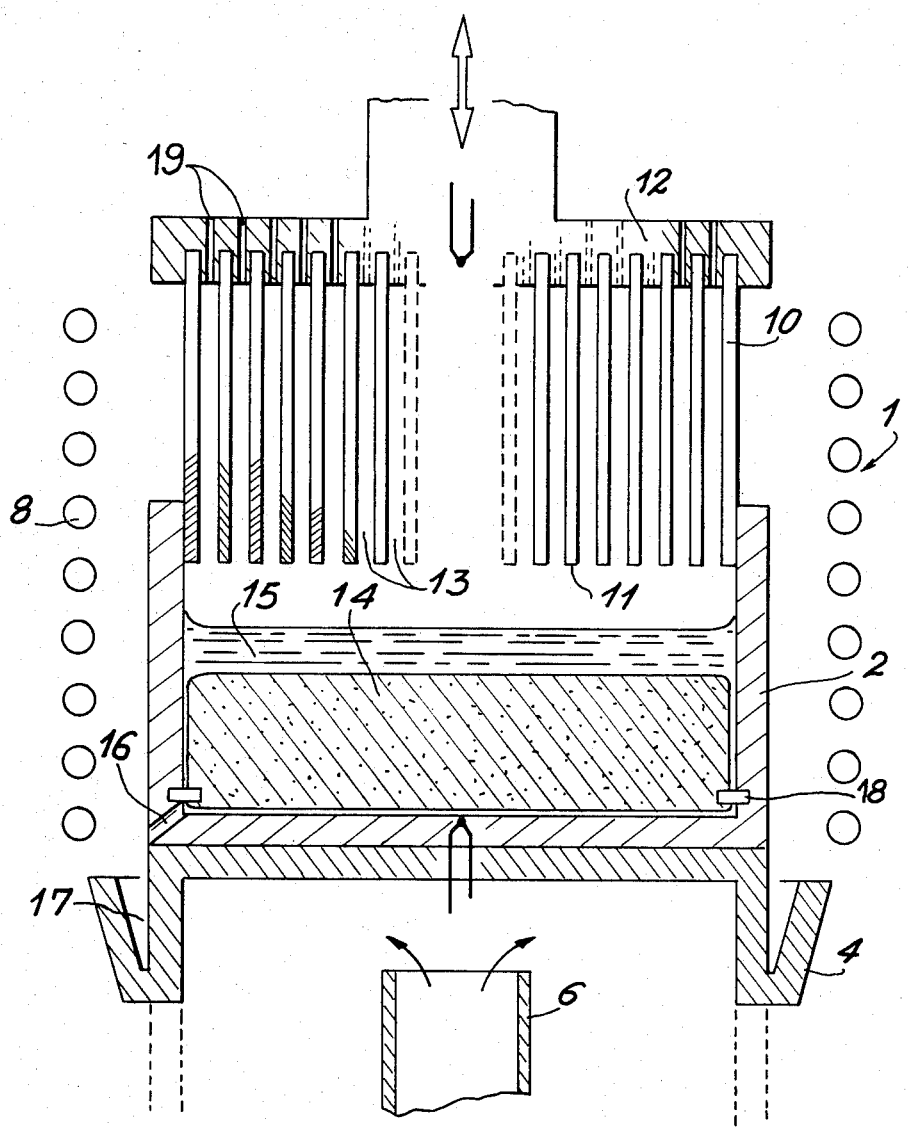
FIG. 1 is a diagrammatic vertical sectional view of a device permitting the performance of the process according to the invention.

FIG. 1 relates to the complete device 1 making it possible to simultaneously prepare a large number of silicon plates. A graphite crucible 2 is placed on a graphite base 4 ensuring a very uniform and highly satisfactory thermal contact with the bottom surface of the crucible. This base can be cooled by the internal circulation of a heat transfer fluid arriving via a duct 6. The four faces of the rectangular crucible 2 are heated by electrical resistors 8. In the present embodiment, it is a question of producing rectangular silicon plates having 80×80 mm sides and a thickness of 1 to 1.5 mm. For this purpose, the crucible has the shape of a parallelepiped, with a depth of 100 mm, a width of 100 mm and a length of approximately 300 mm. The shaping means or mould is constituted by a series of 45 plates 10 held in place by a vertically movable support 12, so that they can be introduced into crucible 2. In order to permit the rising of materials between the plates, the upper parts of the spaces between said plates communicate with the atmosphere by openings 19. The graphite plates 10 have a thickness of 4.5 mm and are kept strictly equidistant from one another by an appropriate means. In order to ensure a regular penetration of the materials between the plates, the mould and crucible must accurately fit into one another. The drawing also shows a liquid silicon mass 14 in the bottom of the crucible, above which there is a liquid mass 15 of a second material, whereby mass 14 is separated from the walls of crucible 2 by a liquid film of material 15. In the present embodiment, the second material 15 is a eutectic mixture of calcium fluoride and magnesium fluoride, whose melting point is 980° C. The operation of preparing the silicon plates with the present device takes place in the following manner.

The surface tensions $\sigma$ of the plate, the mass 14 and the mass 15 satisfy the following relationship:

$\sigma$ mass 14/plate $>\sigma$ mass 14/mass 15 $+\sigma$ mass 15/plate where:

$\sigma$ mass 14/plate is the surface tension between the mass 14 and the plate;

$\sigma$ mass 15/plate is the surface tension between the mass 15 and the plate; and $\sigma$ mass 14/mass 15 is the surface tension between the mass 14 and the mass 15.

After melting both materials 14 and 15, the group of plates 10 is lowered until the lower end 11 thereof comes into contact with the free surface of liquid 15. Plates 10 are slowly lowered, so that liquid 15, which has a good wetting power, completely impregnates these plates. The downward movement is continued until the lower end 11 of plates 10 reaches the liquid silicon mass 14. At this moment, the silicon starts to rise in the spaces 13 between the plates as they are lowered, but remains separated therefrom by a liquid film of material 15, which is maintained on the walls of the mould. When the plates 10 have reached the end of their travel, the silicon is solidified from the bottom by introducing a cooling fluid beneath base 4. This leads to solid silicon plates separated from the graphite or alumina plates 10 by a film of the second material 15, which is still liquid because its boiling point is chosen well below that of the boiling point of silicon. As the latter is soldified and the second material 15 is still liquid, plates 10 are removed. In the case of FIG. 1, lugs 18 are provided to keep the solidified silicon in the crucible. The second liquid material is removed from the gaps between the silicon plates. For this purpose it is possible to provide openings 16 in the lower part of crucible 2, in order that the liquid can flow into a container 17 provided in graphite support 4. Crucible 2 containing the silicon plates is then cooled to ambient temperature and the residual film of material 15, which may still adhere to the plates is dissolved by acid washing. The silicon plates are then removed and a second cycle can start. In this way it is possible to obtain an output of 1 $m^2/h$. Obviously the plates could be separated after solidification and the separated plates could then be washed.

Figure 2:
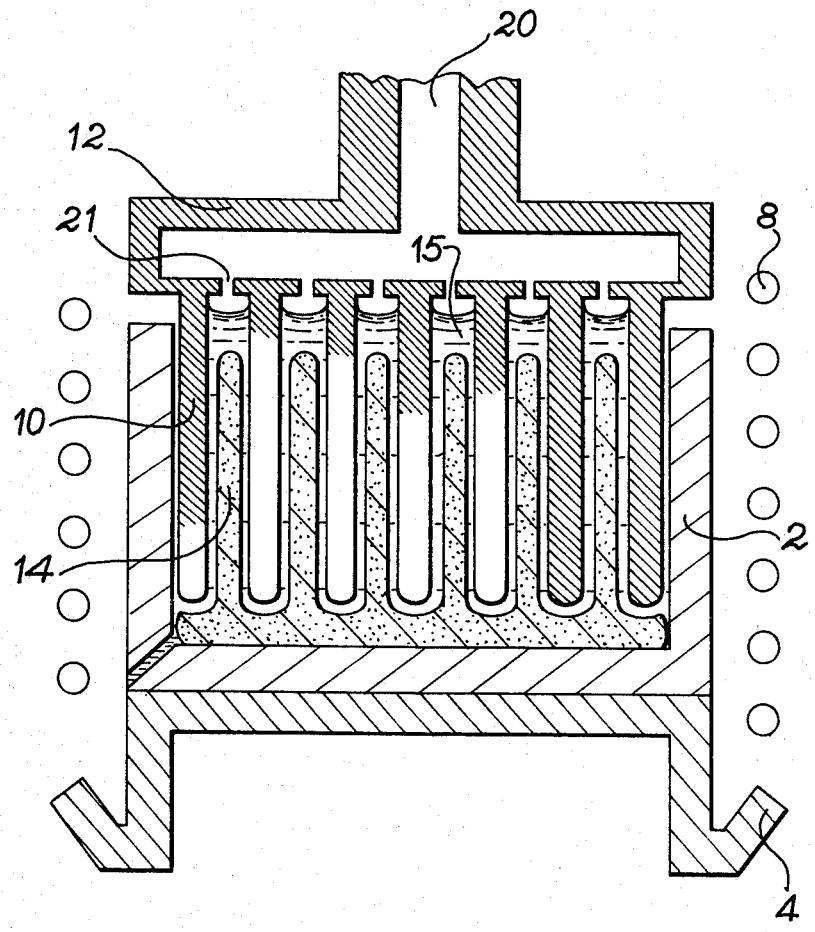
FIG. 2 is a diagrammatic vertical sectional view of another device permitting the performance of the process according to the invention.

FIG. 2 is a diagrammatic sectional view of another device permitting the performance of the present process. The elements corresponding to those of FIG. 1. carry the same reference numerals. It is possible to see a graphite crucible 2 placed on a base 4, which ensures a good thermal contact with the bottom of crucible 2, the heating resistors 8 being responsible for the heating of the crucible.

In FIG. 2, the plates 10 joined to the moving support 12, are shown lowered into the crucible and after the solidification of silicon plates 14. The silicon plates, separated from the plates 10 of the mould by the bath of the still liquid second material 15, are extracted by introducing a pressurized fluid (e.g. nitrogen) into a duct 20 machined into support 12. Openings 21 enable the pressurized fluid to penetrate between plates 10 of the mould. Thus, during the upward movement of the mould, the silicon plates are maintained in crucible 2. Only the silicon plate extraction means have changed, the various stages of the process described in FIG. 1 remaining the same.

The process according to the invention has numerous particularly interesting advantages because it has been possible to obtain very good crystalline structures and top quality untreated surface states. Furthermore, the liquid flux along the walls of the mould acts as a lubricant and facilitates the extraction from the mould. The hot mould removal operation, prior to the solidification of the interposed liquid film, leads to a saving in time and eliminates any risks of damage to the silicon plates due to the thermal stresses appearing during the complete cooling of the charge. Thus, after mould removal and discharging the excess of the second material, only the solidification of the very thin residual film of the second material can cause mechanical stresses and consequently the latter are very low. These stresses are further reduced due to the limited adhesion of the second material, which ensures a good surface state of the silicon plates. The complete removal of the residual film is brought about the selective acid dissolving, the use of a dissolving flux or a physical process.

It is obvious that the invention is not limited to the embodiments described and represented herein and numerous variants are possible thereto without passing beyond the scope of the invention. Thus, the material forming the protective liquid film and the material forming the walls of the mould can be chosen as a function of what it is wished to obtained.

What is claimed is:

1. A process for the preparation of plates of a first metallic or semimetallic material from a liquid mass of said material contained in a production device comprising on the one hand a crucible which also contains a second material, which is chemically inert with respect to the first, and on the other hand a shaping means, the second material having a density which is at the most equal to that of the first material and is immiscible therewith, whilst having a melting point well below that of the first material and a wetting power which is higher than that of the first material with respect to the production device, wherein the process comprises the following stages:

said shaping means having a group of parallel, equidistant, refractory plates, having walls, is lowered into the crucible until the lower end of the plates comes into contact with the second material wetting said walls:

the first material is made to penetrate spaces between the plates and is separated from the walls by a liquid film of the second material;

planned cooling takes place until the material to be produced solidifies, the second material remaining in liquid form;

the plates are removed;

the second material in excess is discharged;

cooling takes place to ambient temperature;

and the film of the second material which could still adhere to the first is removed.

2. A process according to claim 1, wherein the material to be produced is silicon.

3. A process according to claim 1, wherein the second material is a product based on alkaline earth fluorides.

4. A process according to claim 1, wherein the production device is made from high purity graphite.

* * * * *